US005964271A

United States Patent [19]

Lapointe

[11] Patent Number: 5,964,271

[45] Date of Patent: Oct. 12, 1999

[54] AUTOMATIC SCREEN STRUCTURE

[76] Inventor: Serge Lapointe, 221 des Pins, St-Amable, Quebec, Canada, J0L 1N0

[21] Appl. No.: 09/071,767

[22] Filed: May 1, 1998

[51] Int. Cl.[6] ..... A47G 5/02

[52] U.S. Cl. ..... 160/273.1; 160/264; 160/271

[58] Field of Search ..... 160/264, 273.1, 160/271, 272, 237

[56] References Cited

U.S. PATENT DOCUMENTS

| | | | |
|---|---|---|---|
| 2,615,513 | 10/1952 | Radford | 160/273.1 X |
| 3,797,553 | 3/1974 | Elliott | 160/273.1 X |
| 4,586,552 | 5/1986 | Labelle | 160/264 X |
| 5,307,859 | 5/1994 | Kraeutler | 160/264 |
| 5,353,858 | 10/1994 | Hartmann | 160/264 |
| 5,445,209 | 8/1995 | Lichy | 160/273.1 |

*Primary Examiner*—Blair M. Johnson
*Attorney, Agent, or Firm*—Eric Fincham

[57] ABSTRACT

A storable screen assembly wherein a first and second vertical post have a screen extending therebetween, each of the posts having a vertically extending channel therein and a slot in facing side walls to receive the screen, the flexible screen having a guiding element secured to each of the side marginal edges which fit through the slots and remain within the vertically extending channels, the guiding element having a C-shaped portion which remains within the channel, the guide element being of a flexible resilient material.

4 Claims, 2 Drawing Sheets

AUTOMATIC SCREEN STRUCTURE

BACKGROUND OF THE INVENTION

The present invention relates to a storable screen assembly and more particularly, relates to a storable screen assembly which may be utilized with flexible screens for enclosing outdoor structures.

In temperate climate zones, people generally enjoy being outdoors to the maximum extent possible. This is exemplified by the common use of patios, decks and the like.

Naturally, protection must be afforded to both people and other objects using the outdoor structure during adverse conditions. Many commercial structures and accessories are available including windows, screens, etc. While there are many choices, the key requirements are for an aesthetic appearance and a good functionality. Also, the option of removing the structures when not desired is preferable.

With respect to screen structures, generally the screens are mounted in a structure in a fixed manner. Thus, the screens have their own frame which is mounted within a walled arrangement such that the frames and hence the screens are retained in a desired position. Such screens are normally left in the desired position for the length of time that the structure is used since to remove them is a relatively time consuming process and a storage space must also be provided.

However, the screens are not always necessary and in many locations, the screens are only required after a certain hour when insects are prevalent.

SUMMARY OF THE INVENTION

It is accordingly an object of the present invention to provide for a screen structure which may be moved into and out of a stored position and which structure is aesthetically pleasing.

According to one aspect of the present invention, there is provided a storable screen structure comprising first and second vertical members, each of the vertical members having a vertically extending channel therein, each of the vertical members having respective facing side walls, a slot formed in each of the facing side walls and communicating with a respective one of the channels, a housing, a roller mounted in the housing, a flexible screen entrained about the roller, the screen having side marginal edges with a guiding element being secured to each of the side marginal edges, the guiding elements each having a first portion secured to the marginal edge of the screen and a C-shaped portion extending outwardly therefrom, the C-shaped portion being designed to fit within a respective one of the channels in the vertical posts, the guide element being of a flexible resilient material.

In greater detail, the storable screen structure of the present invention provides an arrangement wherein a screen may be lowered from a housing or retracted therein. When retracted, there is provided free access with the only permanent structure being posts and a header. The distances between the posts can be substantial thus providing a very clean aesthetic appearance.

The storable screen structure utilizes, as aforementioned, guiding elements which fit within a channel within each of the posts. The guiding elements are in a C-shaped configuration to allow for them to roll on each other when in a stored position. The C-shaped configuration prevents easy withdrawal of the elements through the channel while still permitting such movement when desired. As such, the guide elements are made of a suitable material such as a rubber or plastic material.

Drive means are associated with the roller and can be mechanical or electrical. Thus, the well known arrangement wherein the roller may be turned by a hand tool may be employed or alternatively, an electric motor could be utilized.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
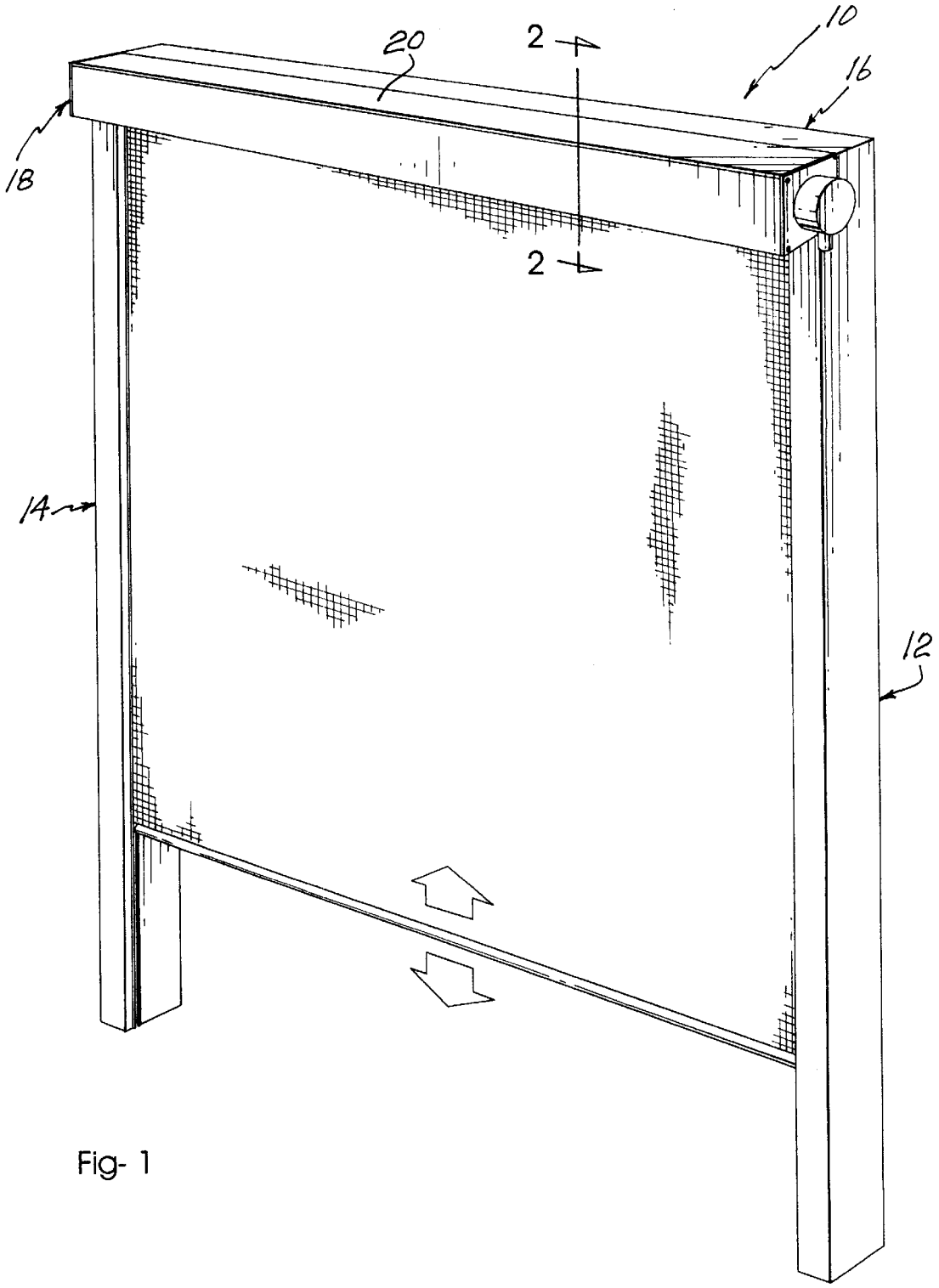
FIG. 1 is a perspective view of a storable screen structure according to the present invention.

Referring to the drawings in greater detail and by reference characters thereto, the screen structure of the present invention is generally designated by reference numeral 10. The structure includes a first vertical post 12, a second vertical post 14 and a horizontal header 16 extending therebetween. A screen storage housing 18 is secured to horizontal header 16 and extends between posts 12 and 14 which may be structural posts to support a patio roof.

Figure 2:
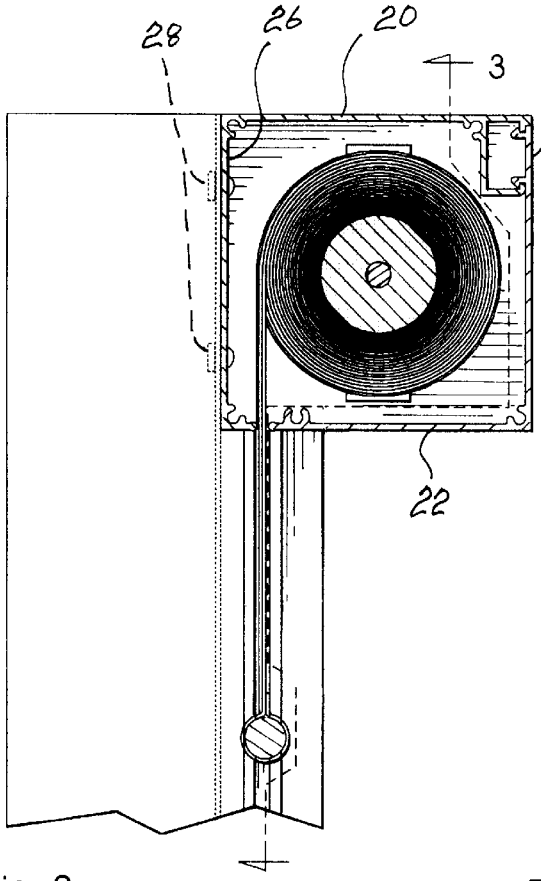
FIG. 2 is a cross sectional view taken along the line 2—2 of FIG. 1.
Figure 3:
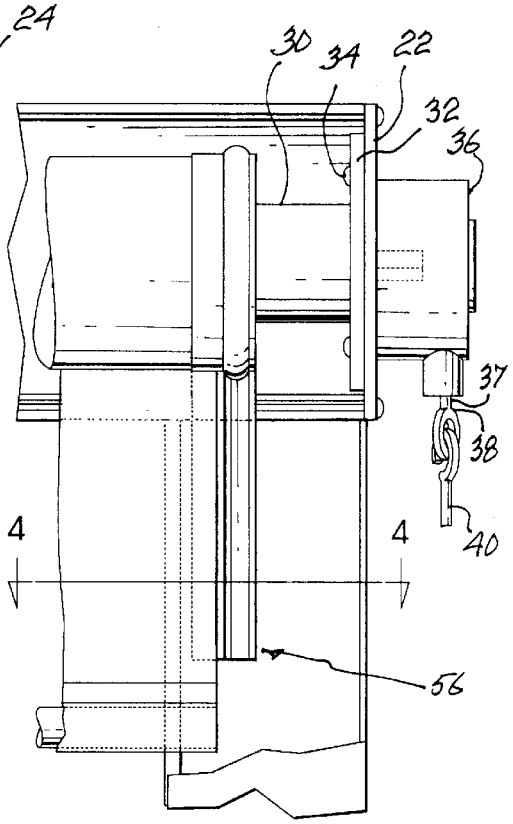
FIG. 3 is a detail view, partially in cutaway, of one end of the screen structure.
Figure 5:
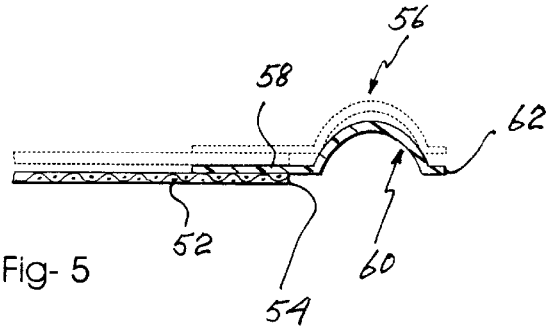
FIG. 5 is an enlarged detail view showing the marginal edge of the flexible screen.

Screen storage housing 18, as may be seen in FIG. 2, has a top wall 20, a bottom wall 22, a front wall 24 and a rear wall 26. Screen housing 18 may conveniently be formed as an extrusion. As shown in FIG. 2, the housing is mounted to horizontal header 16 by means of fasteners 28 extending through rear wall 26.

Mounted within housing 18 is a roller 30. At either end (only one shown), roller 30 is mounted on a roller support plate 32 which in turn is secured to end wall 27 by means of fasteners 34.

An exterior casing 36 has a downwardly extending shaft 37 with an eye 38 mounted thereon. Shaft 37 is connected to a conventional winding arrangement (not shown) for roller 30. A conventional winding tool 40 is designed to fit within eye 38 to impart rotational movement which in turn is translated into rotation of roller 30.

Figure 4:
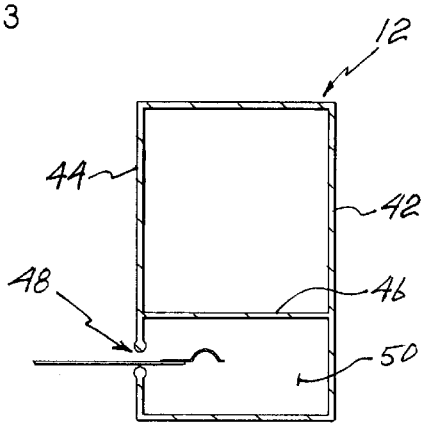
FIG. 4 is a sectional view taken along the line 4—4 of FIG. 3.

First vertical post 12 is illustrated in FIG. 4 and as may be seen, includes opposed side walls 42 and 44 with a reinforcing rib 46 extending therebetween. There is thus provided an interior channel or cavity 50 with a slot 48 being formed on inner side wall 44.

A flexible screen 52 is designed to be wound about roller 30. Screen 52 includes a marginal edge 54 to which there is secured a guide element 56. Guide element 56 has a first planar portion 58 which is secured to screen 50 by suitable means (mechanical stitching, adhesive, welding, etc). A C-shaped portion 60 is provided adjacent planar portion 58 with C-shaped portion 60 terminating in a marginal flange 62.

As shown in FIG. 4, the arrangement is such that guide element 56 fits within slot 48 of wall 44 and is retained within channel 50 due to C-shaped portion 60.

During the motion of winding or unwinding of screen 52, guide element 56 remains within channel 50 to assure the maintenance of the position of the screen. When the screen is wound upon roller 30, the various layers of guide element 56 rolled on top of each other remain in a nested position.

Guide element 56 is of a flexible nature such that, if desired, it can be removed from within channel 50 by manual manipulation since slot 48 has a thickness greater than C-shaped portion 60. Similarly, it can easily be reinserted through slot 48 when required. Also, channel 50 is sized substantially larger than C-shaped portion 60 to permit free movement thereof within channel 50.

It will be understood that the above described embodiments are for purposes of illustration only and that changes and modifications may be made thereto without departing from the spirit and scope of the invention.

I claim:

1. A storable screen structure consisting essentially of first and second vertical posts, each of said vertical members having a vertically extending channel therein, each of said vertical members having respective facing side walls, a slot formed in each of said facing side walls and communicating with a respective one of said channels, a housing, a roller mounted in said h a flcable screen entrained about said roller, said screen having side marginal edges, a guiding element being secured to each of said side marginal edges, said guiding elements each having a first portion secured to said marginal edge of said screen and a C-shaped portion extending outwardly therefrom, said C-shaped portion being designed to fit within a respective one of said channels in said vertical posts, each C-shaped portom defining a curve having a depth, said depth being greater than the width of the slot and said C-shaped portion, each C-shaped portion defining a curve having a depth, said depth being greater than the width of the slot having a thickness less than the width of said slot, said guide element being of a flexible resilient material each of said channels being sized substantially larger than said C-shaped portion to permit free movement of said C-shaped portion within said respective one of said channels, the arrangement being such that said C-shaped portion is retained in said channel during normal upward and downward movement of said screen, said slot permitting withdrawal of said screen when a sufficient force is applied to said screen and also permitting reinsertion of said C-shaped portion through said slot.

2. The screen structure of claim 1 wherein said guide element is formed of a flexible rubber material.

3. The screen structure of claim 1 further including means for winding and unwinding said screen on said roller, said means comprising an electric motor.

4. In a patio structure having a roof covering at least a portion of a patio and at least first and second vertical posts supporting said roof, the improvement wherein each of said vertical members has a vertically extending channel formed therein, each of said vertical members having respective facing side walls, a slot being formed in each of said facing side walls and communicating with a respective one of said channels, a housing extending between said vertically extending channels proximate said roof, a roller mounted in said housing, a flexible screen entrained about said roller, said screen having side marginal edges, a guiding element being secured to each of said side marginal edges, said guiding elements each having a first portion secured to said marginal edge of said screen and a C-shaped portion extending outwardly therefrom, said C-shaped portion being designed to fit within a respective one of said channels in said vertical posts, each C-shaped portion defining a curve having a depth, said depth being greater than the width of the slot, each C-shaped portion having a thickness less than the width of said slot, each of said guide elements being of a flexible resilient material, the arrangement being such that said C-shaped portion is retained in said channel during normal upward and downward movement of said screen, said slot permitting withdrawal of said screen when a force is applied thereto and also permitting reinsertion of said C-shaped portion through said slot.

* * * * *